US005469716A

United States Patent [19]

Bass et al.

[11] Patent Number: 5,469,716

[45] Date of Patent: Nov. 28, 1995

[54] SCROLL COMPRESSOR WITH LIQUID INJECTION

[75] Inventors: Mark Bass, Sidney, Ohio; Alexander P. Rafalovich, Indianapolis, Ind.

[73] Assignee: Copeland Corporation, Sidney, Ohio

[21] Appl. No.: 237,449

[22] Filed: May 3, 1994

[51] Int. Cl.[6] ..... F25B 31/00; F04C 18/04; F04C 29/04

[52] U.S. Cl. ..... 62/505; 418/55.6; 418/97

[58] Field of Search ..... 418/55.1, 55.6, 418/97; 62/505

[56] References Cited

U.S. PATENT DOCUMENTS

| | | | |
|---|---|---|---|
| 3,994,633 | 11/1976 | Shaffer | 418/5 |
| 4,082,484 | 4/1978 | McCullough | 418/57 |
| 4,160,629 | 7/1979 | Hidden et al. | 418/55.3 |
| 4,192,152 | 3/1980 | Armstrong et al. | 418/5 |
| 4,469,126 | 9/1984 | Simpson | 417/569 |
| 4,475,360 | 10/1984 | Suefuji et al. | 62/324.1 |
| 4,494,914 | 1/1985 | Shiibayashi | 418/55.2 |
| 4,545,747 | 10/1985 | Tamura et al. | 418/98 |
| 4,549,861 | 10/1985 | Blain | 418/88 |
| 4,553,913 | 11/1985 | Morishita et al. | 418/60 |
| 4,560,330 | 12/1985 | Murayama et al. | 418/55.1 |
| 4,568,256 | 2/1986 | Blain | 418/94 |
| 4,569,521 | 2/1986 | Murayama et al. | 418/180 |
| 4,575,318 | 3/1986 | Blain | 418/14 |
| 4,596,520 | 6/1986 | Arata et al. | 418/57 |
| 4,600,369 | 7/1986 | Blain | 418/57 |
| 4,610,610 | 9/1986 | Blain | 418/14 |
| 4,611,975 | 9/1986 | Blain | 418/5 |
| 4,613,291 | 9/1986 | Sidransky | 418/15 |
| 4,676,075 | 6/1987 | Shiibayashi | 62/469 |
| 4,690,625 | 9/1987 | Murayama et al. | 418/55.2 |
| 4,744,737 | 5/1988 | Yamamura et al. | 417/902 |
| 4,767,293 | 8/1988 | Caillat et al. | 418/57 |
| 4,802,831 | 2/1989 | Suefuji et al. | 418/56 |
| 4,818,195 | 4/1989 | Murayama et al. | 418/15 |
| 4,889,471 | 12/1989 | Izunaga et al. | 418/94 |
| 4,929,160 | 5/1990 | Inoue | 418/181 |
| 4,936,756 | 6/1990 | Shimizu et al. | 417/371 |
| 4,950,135 | 8/1990 | Tojo et al. | 418/55.5 |
| 4,992,033 | 2/1991 | Caillat et al. | 418/55.3 |
| 5,037,279 | 8/1991 | Suefuji et al. | 418/55.2 |
| 5,040,958 | 8/1991 | Arata et al. | 418/55.5 |
| 5,090,880 | 2/1992 | Mashimo | 418/55.1 |
| 5,103,652 | 4/1992 | Mizuno et al. | 418/55.6 |

FOREIGN PATENT DOCUMENTS

| | | | |
|---|---|---|---|
| 57-76286 | 5/1982 | Japan | 418/97 |
| 59-34494 | 2/1984 | Japan . | |
| 60-1396 | 1/1985 | Japan . | |
| 61-197782 | 9/1986 | Japan . | |
| 63-1792 | 1/1988 | Japan . | |
| 63-223379 | 9/1988 | Japan . | |
| 1-106987 | 4/1989 | Japan . | |
| 2245490 | 10/1990 | Japan | 418/55.6 |
| 3156186 | 7/1991 | Japan | 418/97 |

*Primary Examiner*—John J. Vrablik
*Attorney, Agent, or Firm*—Harness, Dickey & Pierce

[57] ABSTRACT

A scroll-type compressor has a liquid injection system for injecting liquid into an enclosed space defined by first and second scroll members which engage in cyclical relative orbiting motion, to reduce the temperature of the working fluid. The compressor incorporates a discharge diffuser for reducing the pressure of the working fluid in an enclosed space, so that the liquid may be injected into the enclosed space from a more centrally located injection port than one which would allow liquid injection without the discharge diffuser.

21 Claims, 4 Drawing Sheets

SCROLL COMPRESSOR WITH LIQUID INJECTION

BACKGROUND AND SUMMARY OF THE INVENTION

The present invention relates generally to hermetic compressors, and more particularly to compressors of the scroll type.

Refrigeration and air conditioning systems generally include a compressor, a condenser, an expansion valve (or equivalent), and an evaporator, coupled in sequence in a continuous flow path. A working fluid or refrigerant flows through the system and alternates between a liquid phase and a vapor or gaseous phase.

A variety of compressor types may be used in refrigeration systems, such as reciprocating, screw, or rotary, including vane and scroll machines. Scroll compressors are constructed with two scroll members, each having an end plate and a spiral wrap, arranged in an opposing manner with the spiral wraps interfitted. The scroll members are mounted so that the scroll members may engage in cyclical orbiting motion with respect to each other. During this cyclical orbiting movement, the spiral wraps define a successive series of enclosed spaces, each of which progressively decreases in size as it moves inwardly from a radially outer position at a relatively low suction pressure to a central position at a relatively high central pressure. The compressed gas exits from the enclosed space at the central position through a discharge passage formed through the end plate of one of the scroll members.

Under any one of a number of adverse conditions, the discharge gas can become excessively hot, which can adversely effect efficiency and the durability of the compressor. One known method of cooling the compressed gas is to inject liquid refrigerant from the outlet of the condenser through an injection passage directly into the compressor. The liquid may be injected into the suction gas area of the compressor, or into an intermediate enclosed space defined by the scroll members. These methods are variously shown in U.S. Pat. No. 5,076,067, entitled "Compressor With Liquid Injection", and U.S. Pat. No. 4,974,427, entitled "Compressor System With Demand Cooling", and patent application Ser. No. 07/912,908, filed on Jul. 13, 1992, U.S. Pat. No. 5,329,788, entitled "Scroll Compressor With Liquid Injection", all of which are assigned to the same assignee as the present application, the disclosures of which are hereby incorporated herein by reference. It is desirable for maximum effective cooling of the discharge gas that the liquid injection port be located as centrally, or as close to the discharge passage, as is possible. Unfortunately, however, the location of the injection port is limited by the liquid supply pressure at the outlet of the condenser, which is intermediate the suction pressure and discharge pressure of the compressor. If the pressure of the gas in an enclosed space near the discharge port is greater than the condenser outlet liquid supply pressure throughout an entire cycle of orbiting motion, then no liquid refrigerant can flow to the enclosed space in the compressor from the liquid injection passage.

It is therefore desirable to lower the pressure of the central enclosed space to below the liquid supply pressure during at least a portion of the cycle of orbiting movement, to enable positive injection through a more centrally located injection port (i.e. closer to the discharge port where the gas is hottest, and where cooling is most effective). One method of lowering the pressure in the central enclosed chamber is the use of a dynamic one-way valve in the discharge passage which opens and closes once every cycle. Such valves, however, are often noisy, unreliable, and reduce compressor efficiency due to valve losses in normal operation. They also add additional cost for the extra hardware, as well as for assembly.

In contrast, the present invention provides a unique configuration which includes a liquid injection passage in combination with a discharge diffuser for reducing the pressure in the enclosed spaces, allowing liquid injection at a later time in the cycle, from a more central position, thereby enabling more effective cooling of the working fluid.

Moreover, liquid injection systems having one injection port are generally capable of injecting liquid into only one of the enclosed spaces defined by the scroll members during each cycle of orbiting motion. It is desirable to provide a liquid injection system having only one injection port, yet which is capable of injecting liquid into more than one of the enclosed spaces in each cycle of orbiting motion.

The present invention has as its object the obviation of the problems associated with the current art by providing a uniquely configured liquid injection apparatus which provides highly effective cooling.

The various advantages and features will become apparent from the following description and claims in conjunction with the accompanying drawings:

DETAILED DESCRIPTION OF THE PREFERRED EMBODIMENTS

The following description of the preferred embodiment is merely exemplary in nature and is in no way intended to limit the invention or its application or uses.

Figure 1:
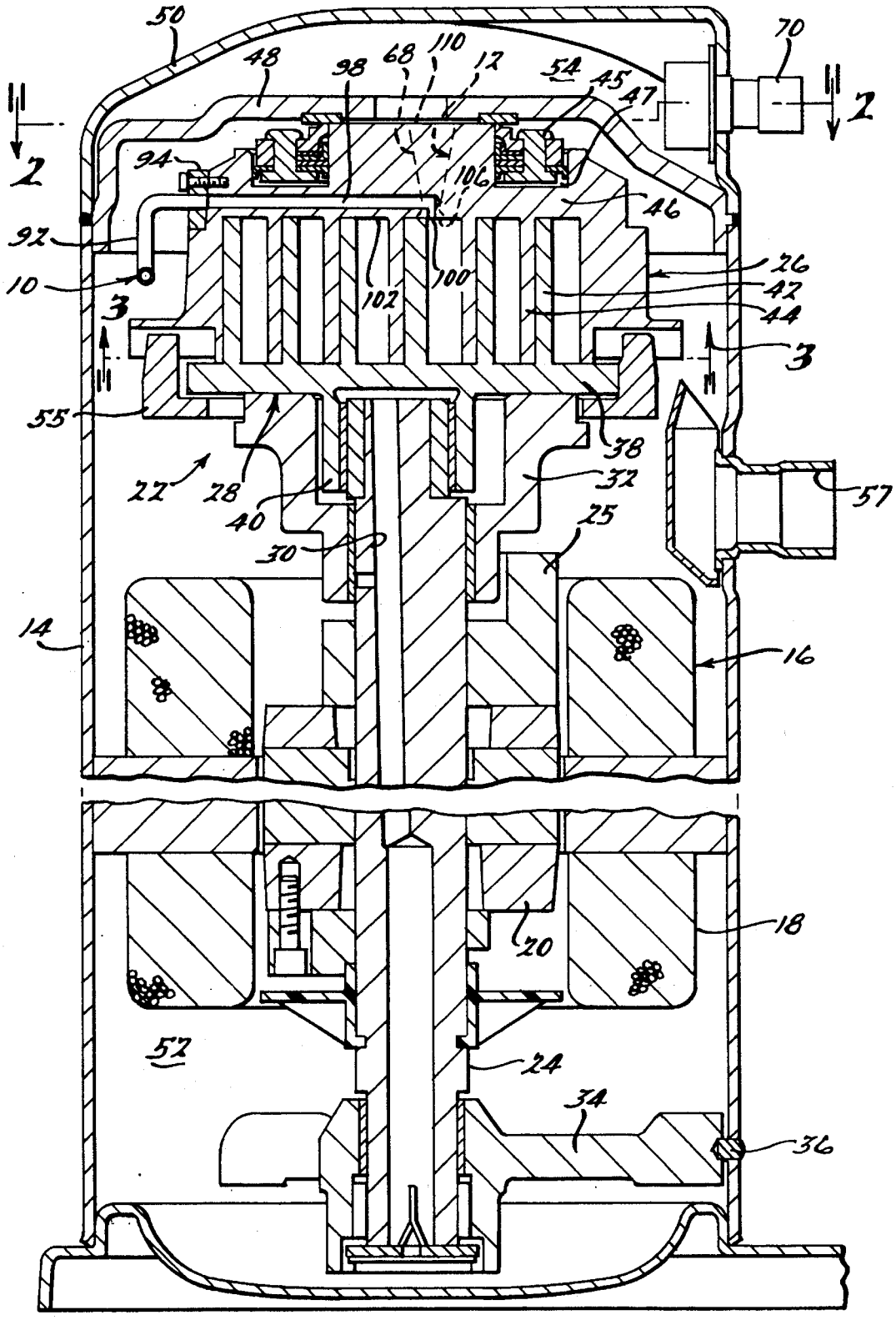
FIG. 1 is a vertical sectional view of a scroll compressor embodying the principles of the present invention, taken along line 1—1 in FIG. 2.
Figure 2:
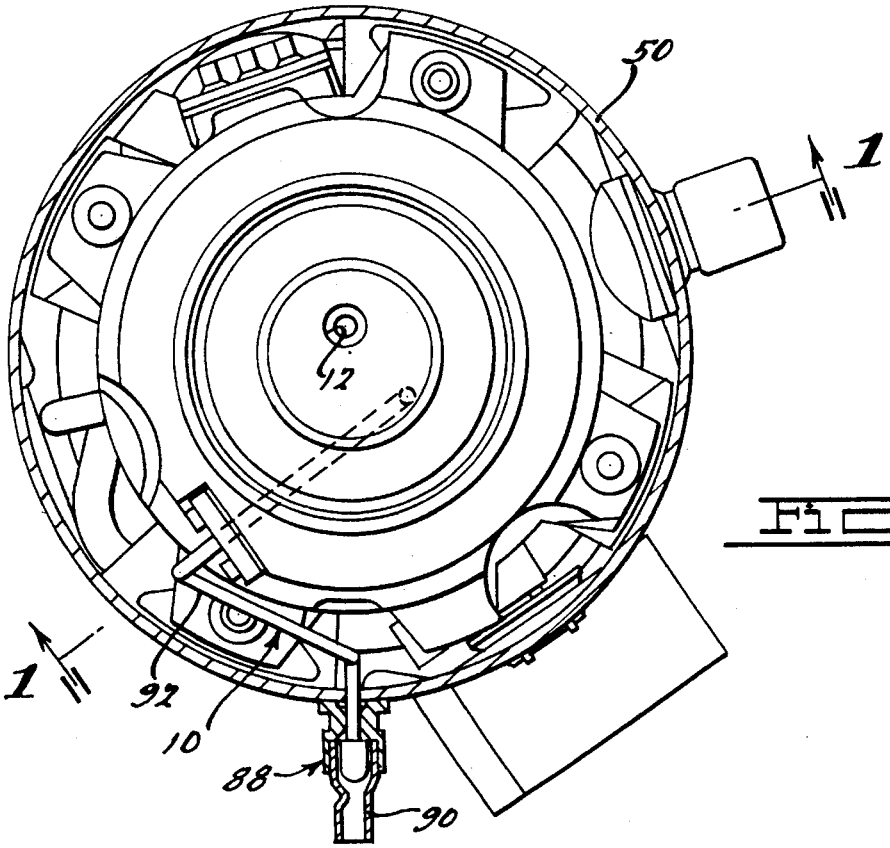
FIG. 2 is a horizontal sectional view of the scroll compressor of the present invention, taken along line 2—2 in FIG. 1.

Referring now to the drawings, and more specifically to FIG. 1, there is shown a hermetic refrigeration scroll compressor incorporating the unique liquid injection system 10, as well as the discharge diffuser 12, of the present invention.

The scroll compressor is constructed in a similar manner as disclosed in U.S. Ser. No. 07/912,897, filed on Jul. 13, 1992, U.S. Pat. No. 5,342,183, entitled "Scroll Compressor With Discharge Diffuser", which is assigned to the same assignee as the present application, the disclosure of which is hereby incorporated herein by reference.

The scroll compressor has a hermetic shell 14, within the lower portion of which is disposed an electric motor 16 including a stator 18 and a rotor 20. Motor 16 drives a compressor assembly 22 disposed in the upper portion of shell 14 by a drive shaft 24 extending between the compressor assembly 22 and rotor 20, to which drive shaft 24 is secured. Compressor assembly 22 is of the scroll type and incorporates an upper non-orbiting scroll member 26 and a lower orbiting scroll member 28 which is driven by a crank pin 30 on drive shaft 24 in a cyclical orbiting motion relative to the non-orbiting scroll member 26. Drive shaft 24 is affixed to a counterweight 25 and is rotatably supported within shell 14 by means of a main bearing assembly 32 and a lower bearing assembly 34, which may be fixedly secured to shell 14 by means of plug welds 36. Orbiting scroll member 28 is formed having an end plate 38, an axial boss 40, and a spiral wrap 42, which has an inner wrap tip 112. Non-orbiting scroll member 26 has a similar spiral wrap 44, which has an inner wrap tip 114, and end plate 46.

Non-orbiting scroll member 26 is supported and held in position by any of a variety of methods, including those described in U.S. Pat. No. 4,767,293 to Caillat et al., filed on Aug. 22, 1986, and which issued on Aug. 30, 1988, entitled "Scroll Type Machine With Axially Compliant Mounting", which is assigned to the same assignee as the present application; the disclosure of which is hereby incorporated herein by reference. The construction shown in FIG. 1 thus provides an axially compliant mounting arrangement for non-orbiting scroll member 26. A floating seal 45 defines a back pressure chamber 47 which communicates with an enclosed space of intermediate pressure through a back pressure passage (not shown).

A muffler plate 48 is welded to shell 14 along with a top cap or muffler cap 50 to define a compressor chamber 52 and a discharge plenum or muffler chamber 54. Compressor assembly 22 and motor 16 are disposed in said compressor chamber 52.

In operation, motor 16 rotates drive shaft 24 which drives orbiting scroll member 28 in cyclical relative orbiting motion with respect to non-orbiting scroll member 26. The usual Oldham coupling 55 prevents scroll member 28 from rotating about its own axis. Working fluid enters compressor chamber 52 through a suction port 57. Orbiting and non-orbiting spiral wraps 42 and 44 are intermeshed with one another, and their inner and outer flank surfaces cooperate to define a series of successive enclosed spaces, such as enclosed spaces 56, 58, 60 and 62, each of which moves during normal operation from a radially outer position 64 where the refrigerant gas is at a relatively low suction pressure to a central position 66 where the refrigerant is at a relatively high central pressure. Spiral wraps 42 and 44 may be arranged to form one or more than one enclosed space during each cycle of orbiting motion. The compressed gas exits through a discharge passage 68 which incorporates the discharge diffuser 12 of the present invention, and then into muffling chamber 54 where the compressed gas is at a relatively high discharge pressure. The central pressure and the discharge pressure would be substantially equal if discharge passage 68 were sufficiently large. The compressed gas then exits muffling chamber 54 through a one-way discharge valve 70.

The present invention provides a unique arrangement including a liquid injection passage in combination with a discharge diffuser, which provides the unexpected benefit of reducing the pressure in the successive enclosed spaces. This pressure reduction enables positive liquid injection to occur at a more central position and at a later time in the orbiting motion cycle, without requiring a dynamic discharge valve which closes during each cycle, or a pump or other device for altering the flow of the liquid to be injected. The liquid is therefore injected nearer to the discharge passage, where the working fluid is hottest and where it cools the working fluid more effectively.

Figure 6:
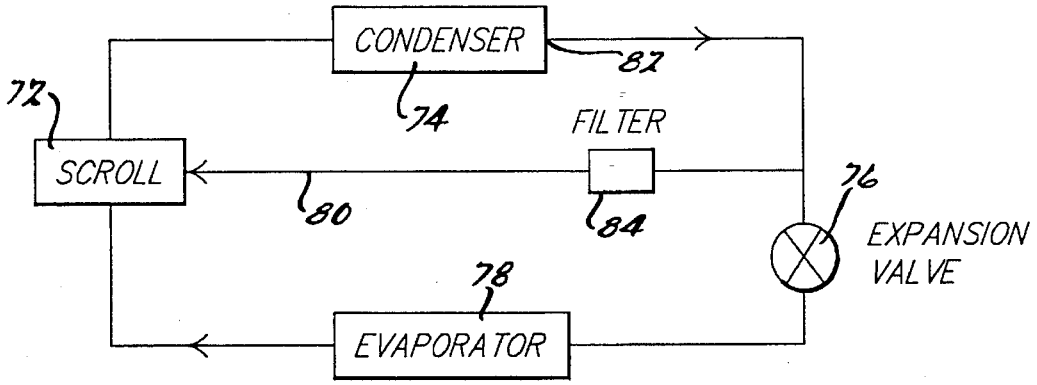
FIG. 6 is a diagrammatic view of a refrigeration system incorporating the present invention.

The novel liquid injection system 10 of the present invention is shown in diagrammatic form in FIG. 6, which illustrates a refrigeration cycle having the elements of a scroll compressor 72, a condenser 74, an expansion valve 76, and an evaporator 78. These elements are coupled in series to form a continuous loop through which a working fluid refrigerant flows. Scroll compressor 72 compresses the refrigerant in a gaseous state, and condenser 74 condenses the gaseous refrigerant to a liquid state, a portion of which is then injected into scroll compressor 72 by liquid injection system 10. The liquid injection system 10 incorporates an injection path defined by a primary tubular member 80 extending from an outlet 82 of the condenser 74, through a filter 84, and into an enclosed space defined by scroll members 26 and 28 within scroll compressor 72. Liquid refrigerant flows from primary tubular member 80 into a connector 88 having a jacket 90, and thereafter into a secondary tubular member 92 which passes through shell 14 and is coupled to a mounting plate 94 having a gasket (not shown) which couples secondary tubular member 92 with a liquid injection passage 98 formed through end plate 46 of non-orbiting scroll member 26. Liquid injection passage 98 extends to a liquid injection port 100 formed on an inner face 102 of end plate 46. Secondary tubular member 92 is preferably formed of a flexible material, such as copper tubing, to allow for the axially compliant mounting arrangement of non-orbiting scroll member 26. The range of axial motion for non-orbiting scroll member 26 is relatively small, so that a more complicated flexible coupling is not necessary for secondary tubular member 92.

To encourage positive liquid injection, the pressure of the liquid refrigerant at outlet 82 should be greater for at least a portion of the cycle of orbiting motion than the pressure of the gaseous refrigerant within an enclosed space which is in fluid communication with liquid injection port 100. Such a positive pressure differential preferably enables liquid injection system 10 to inject liquid without the assistance of a liquid pump or other device for altering pressure or influencing flow. Diffuser 12 encourages positive liquid injection at a later time in the orbiting motion cycle because it reduces the pressure of the gaseous refrigerant within an enclosed space to remain below the supply pressure of the liquid refrigerant until that later time in the orbiting motion cycle.

Figure 5:
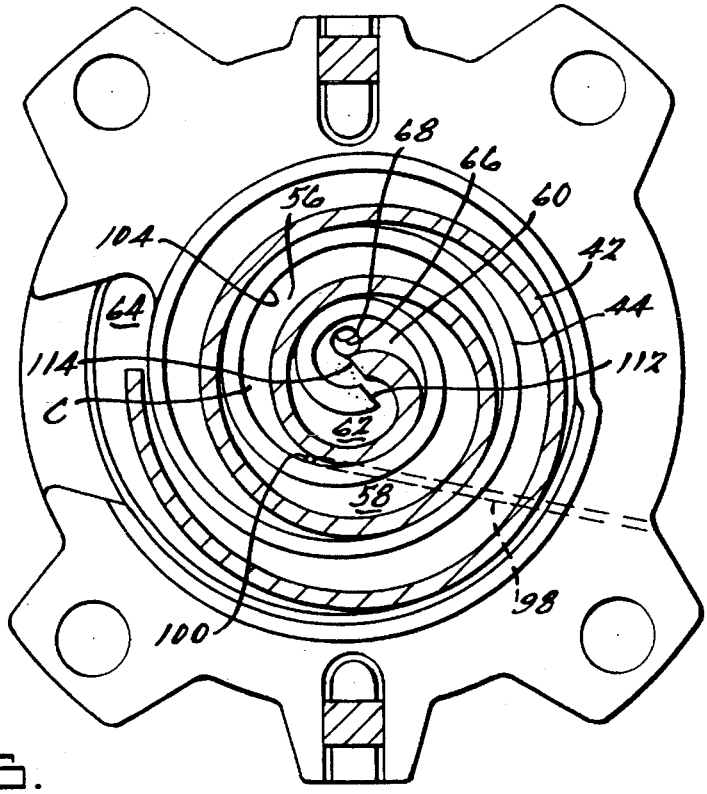
FIGS. 4 and 5 are horizontal sectional views similar to FIG. 3, illustrating various positional arrangements of the scroll members.
Figure 3:
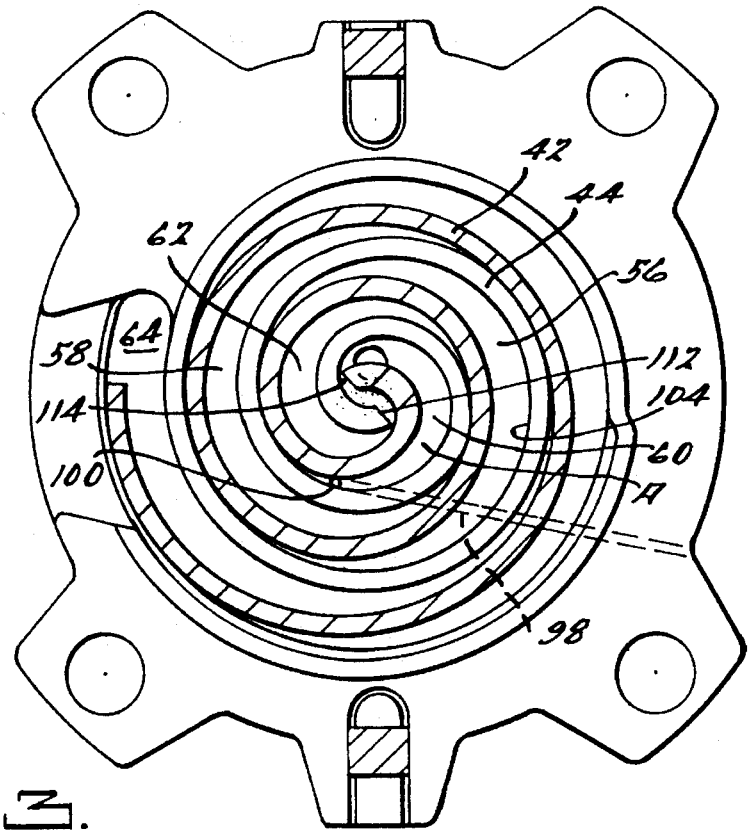
FIG. 3 is a horizontal sectional view, taken along line 3—3 in FIG. 1.

The location of injection port 100 on end plate 46 of non-orbiting scroll member 26 is very important. It is desirable that injection port 100 be located along an inner wall 104 of scroll wrap 44 of non-orbiting scroll member 26 as centrally (i.e. near to discharge passage 68) as possible, in order to be more thermodynamically effective in cooling the working fluid in enclosed spaces 56, 58, 60 and 62. However, if injection port 100 were located too deeply within spiral wrap 44, such as at a position A shown in FIG. 3, then the pressure within enclosed space 60 would be too high for too great a portion of each cycle of orbiting motion. Locating injection port 100 at position A would therefore cause either an insufficient amount of liquid injection for effective cooling of the working fluid, or might even cause reverse flow. On the other hand, if injection port 100 were located at a position which is located too far radially outward, such as position C shown in FIG. 5, then an excessive amount of liquid refrigerant would be injected into enclosed space 56.

In addition, locating injection port at position C would result in unbalanced operation of the scroll compressor.

Figure 4:
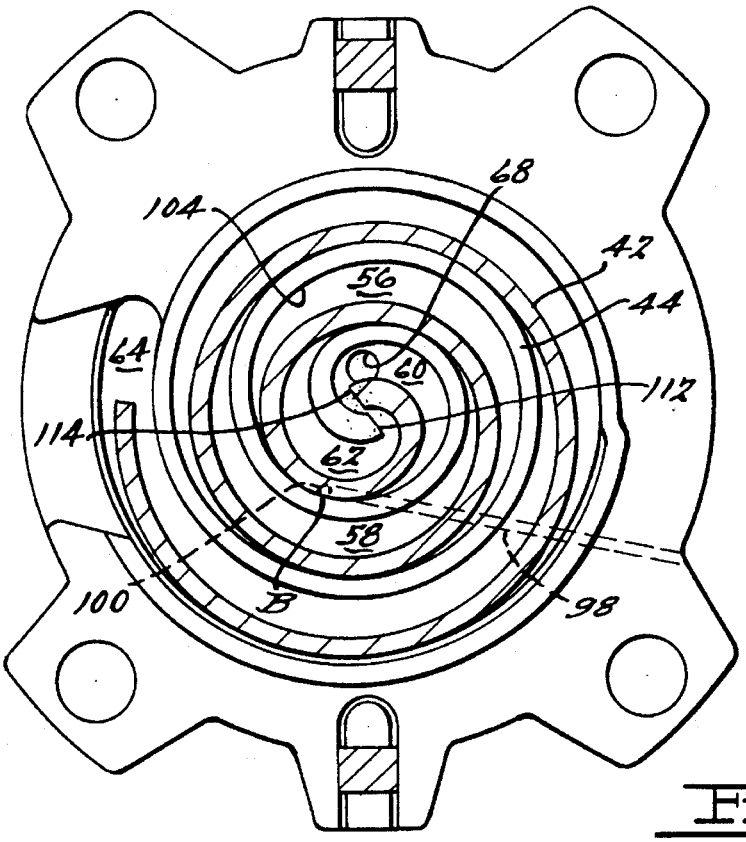

Injection port 100 is therefore preferably disposed at a position B, such as shown in FIG. 4, which is located as centrally as possible on end plate 46 while enabling a sufficient volume of fluid injection. Moreover, operation of the scroll compressor and liquid injection system 10 with injection port 100 disposed at position B allows liquid injection system 10 to inject liquid refrigerant into one enclosed space 60, such as in FIG. 3, as well as a second enclosed space 56, such as in FIG. 5, during one cycle of orbiting motion. As a result, liquid injection system 10 can inject liquid into enclosed space 60 at one time in the cycle of orbiting motion when enclosed space 60 is open to discharge passage 68, and into a second enclosed space 56 at a second time in the cycle when enclosed space 56 is closed off from discharge passage 68. Injection port 100 is of course shut off by spiral wrap 42 of orbiting scroll member 28 for a portion of the orbiting motion cycle, as shown in the arrangement in FIG. 4.

The novel liquid injection system 10 of the present invention is preferably used in conjunction with discharge diffuser 12 to improve the discharge flow and operating efficiency of the scroll machine which has been described thus far. Discharge diffuser 12 has been discovered to provide a more efficient flow passage for the pressurized refrigerant gas. Diffuser 12 preferably has a converging entrance portion and a diverging exit portion disposed between an entrance port 106 and an exit port 110. In an ideal diffuser, in its simplest form, the cross-sectional area of the passage should progressively decrease throughout the converging entrance portion and progressively increase throughout the diverging portion of diffuser 12 in a forward or discharge flow direction. Diffuser 12 should also be formed with a smooth entrance, throat, and exit. Exit port 110 of diffuser 12 will usually communicate with a plenum or muffler chamber 54.

Regardless of the particular configuration of the diffuser, the cross-sectional shape of diffuser 12 is preferably circular. Moreover, the included angle of diverging portion 76 is preferably in the range of 5 to 20 degrees, and ideally is approximately 7 to 15 degrees, depending on its axial length. The length of the diffuser should preferably be as short as possible with respect to the diameter of exit port 110 without increasing pressure losses and choking the discharge flow.

Discharge diffuser 12 is adapted to reduce the pressure in the innermost enclosed space 60 below what it would be if the compressor were equipped with a conventional discharge passage. Diffuser 12 provides for minimum forward pressure losses, while it is believed to increase the efficiency and reliability of the compressor, especially at relatively high pressure ratios. Moreover, it is believed that diverging discharge passage 12 provides the additional advantage of enabling operation of the scroll compressor with an increased compression ratio.

It is also believed that the diffuser 12 of the present invention tends to restrict reverse flow through the discharge passage 18 from plenum chamber 54 and into the most central enclosed space 60 and 62, because the flow may tend to choke in the reverse flow direction. As a result, the working fluid in the most central enclosed space 60 will experience more sudden pressure fluctuation during each cycle of orbiting motion.

Accordingly, working fluid contained in muffler chamber 54 may tend not to reverse flow through discharge passage 68 into innermost enclosed space 60, and thus not to equalize the pressures between muffler chamber 54 and enclosed space 60. The pressure in innermost enclosed space 60 is reduced below the pressure it would be without discharge diffuser 12, preferably below the supply pressure at the outlet 82 of condenser 74 at a later time in the orbiting motion cycle. Because of the resulting positive pressure gradient, positive liquid injection is caused to flow through port 100. This reduction in pressure may occur immediately after spiral wrap 42 crosses discharge passage 68 or after wrap tips 112 and 114 separate. The pressure reduction thus enables injection port 100 to be disposed in a more central location while maintaining adequate liquid injection performance. In other words, liquid injection can occur at a more central location, and at a later time in each cycle of orbiting motion, than would be possible without diffuser 12 and the pressure reduction. Liquid injection system 10 is thus preferably capable of injecting liquid at a time during the cycle of orbiting motion when innermost enclosed space 60 is open to, or in fluid communication with, discharge passage 68. The pressure reduction may thus enable the liquid injection system to inject liquid during a discharge portion of the cycle of orbiting motion, when the working fluid is being discharged through discharge passage 68.

Indeed, the present invention requires no valve along discharge passage 68 which closes in every cycle of orbiting motion to cause the pressure reduction, and discharge passage 68 remains open in fluid communication with plenum chamber 54 throughout each cycle of orbiting motion. Fluid communication refers to a condition in which a path exists by which fluid might flow. In other words, discharge passage 68 is preferably not physically blocked off at any time in an operating cycle from plenum chamber 54. Likewise, the condition of being out of fluid communication means that no such path exists, or that fluid flow is physically closed off.

Figure 8:
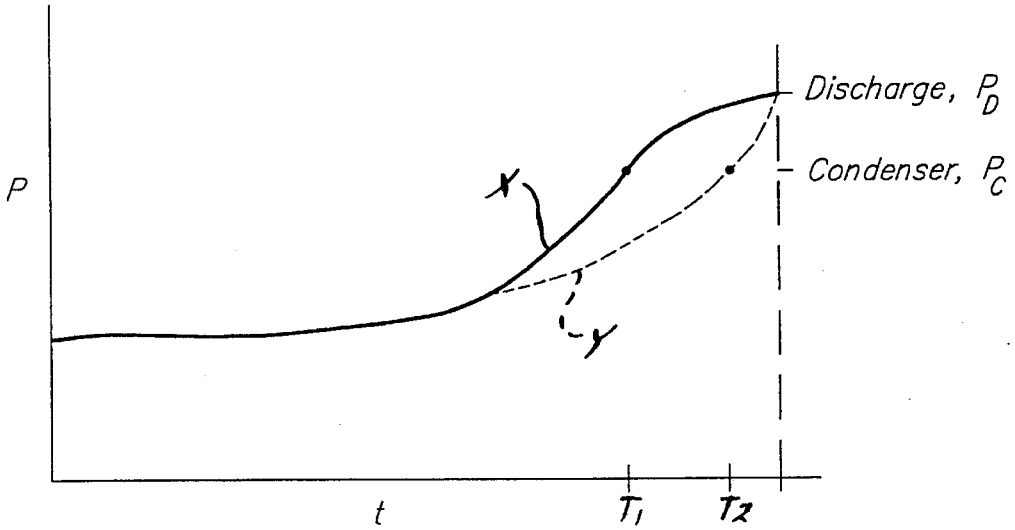
FIG. 8 is a graph showing pressure of an enclosed space during a cycle of orbiting motion of the scroll members of the present invention.

The operation of the present invention is graphically illustrated in FIG. 8, which shows the pressure of the working fluid within a generic enclosed space as it moves from radially outer position 64 to central position 66. A solid line indicated at X illustrates the pressure of an enclosed space in a scroll compressor of the prior art, having a conventional non-diffuser discharge passage. The supply pressure at tile condenser outlet 82, indicated at $P_c$, limits when injection can occur. As a result, liquid injection systems must inject before or at a point where the pressure reaches pressure $P_c$, indicated at time $T_1$.

On the other hand, a dotted line indicated at Y shows the pressure in a generic enclosed space in a scroll compressor incorporating discharge diffuser 12 of the present invention. As shown in FIG. 8, the pressure in the enclosed space reaches supply pressure $P_c$ at a later point in tile cycle of orbiting motion, indicated at time $T_2$. Injection port 100 can therefore be disposed at a more central position, more proximate to discharge passage 68. Injection of liquid closer to discharge passage 68 at a later time in the cycle is more thermodynamically effective for reducing the temperature of the discharge gas.

The novel liquid injection system 10 and discharge diffuser 12 of the present invention thus improve heat transfer from the working fluid because injection port 100 may be disposed in a location more proximate to discharge passage 68, and because injection port 100 may be disposed in a position so as to inject liquid into more than one enclosed space during each cycle of orbiting motion.

Figure 7:
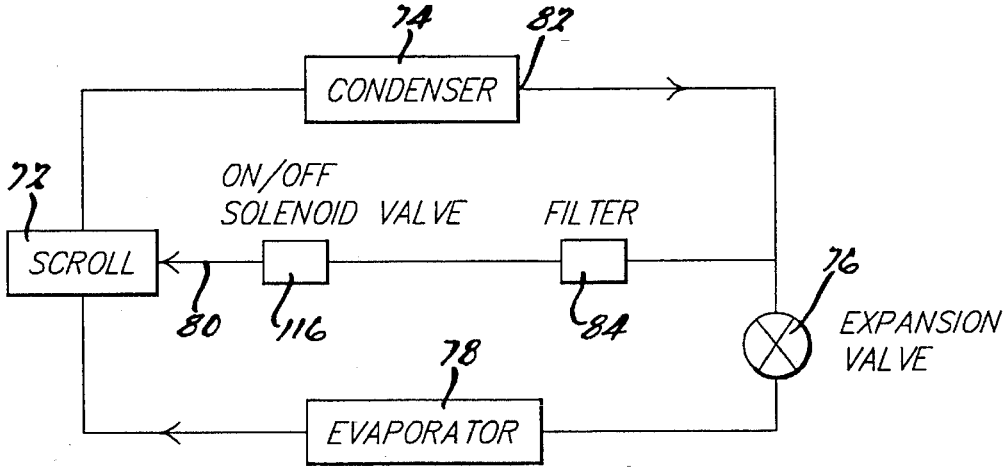
FIG. 7 is a diagrammatic view similar to FIG. 6 showing an alternative embodiment of the present invention.

An alternative embodiment of the present invention is depicted in FIG. 7. The refrigeration cycle may be provided with a solenoid valve 116 for selectively blocking primary tubular member 80 of liquid injection system 10 when the refrigeration cycle is shut off. Valve 116 thus prevents reverse flow from enclosed space after scroll compressor 72 is shut down.

It should be understood that the preferred embodiment of the present invention have been shown and described herein, and that various modifications of the preferred embodiment will become apparent to those skilled in the art after a study of the specification, drawings, and following claims.

What is claimed is:

1. A scroll-type compressor for handling a working fluid, comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a discharge diffuser disposed near said central position and having a diverging sidewall for discharging said working fluid from said enclosed spaces, said discharge diffuser having no discharge value and being adapted to reduce the pressure within an innermost enclosed space to allow for the injection of a liquid into said innermost enclosed space; and a liquid injection circuit for injecting said liquid into said innermost enclosed space to reduce the temperature of said working fluid, said liquid injection circuit including an injection passage extending from a liquid refrigerant supply member to an injection port formed in one of said scroll members, said injection port being disposed proximate to said diffuser such that said injection port is in communication with said discharge diffuser during a portion of said cyclical relative orbiting motion of said scroll members.

2. The scroll-type compressor as claimed in claim 1, wherein said injection port is disposed at a position such that said liquid is injected through said injection port into more than one of said enclosed spaces during each of said cycles of orbiting motion.

3. The scroll-type compressor as claimed in claim 1, wherein said liquid is at a supply pressure in said supply member, said discharge diffuser being adapted for reducing the pressure of said innermost enclosed space to remain below said supply pressure until a later time in said cycle, whereby the resulting pressure differential causes said liquid to be injected into said innermost enclosed space at said later time.

4. The scroll-type compressor as claimed in claim 3, wherein said pressure reduction enables positive liquid injection through said injection port disposed at a more central position than the closest one which would allow liquid injection without said pressure reduction.

5. The scroll-type compressor as claimed in claim 1, wherein said working fluid is a refrigerant.

6. The scroll-type compressor as claimed in claim 5, wherein said scroll-type compressor is arranged in a refrigerating circuit, coupled in series with a condenser, an expansion member, and an evaporator, an outlet of said condenser forming a portion of said liquid refrigerant supply member.

7. The scroll-type compressor as claimed in claim 5, wherein said compressor is arranged in a refrigerating circuit and is adapted to compress said refrigerant in a gaseous state, said liquid injection circuit being adapted to inject said refrigerant in a liquid state.

8. The scroll-type compressor as claimed in claim 1, said liquid injection circuit further comprising a shut-off valve for selectively preventing liquid flow through said injection passage.

9. The scroll-type compressor as claimed in claim 1, further comprising a plenum chamber, said discharge diffuser allowing fluid communication between said plenum chamber and said innermost enclosed space during a portion of said cycle of orbiting motion, said discharge diffuser remaining open in fluid communication with said plenum chamber during normal operation.

10. The scroll-type compressor as claimed in claim 1, said discharge diffuser further comprising a converging entrance portion.

11. The scroll-type compressor as claimed in claim 1, said liquid injection circuit requiring no pump for influencing flow of said liquid through said injection passage.

12. A scroll-type compressor for handling a working fluid, comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a discharge diffuser having a diverging sidewall for discharging said working fluid from said enclosed spaces, said discharge diffuser having no discharge value and being adapted to reduce the pressure within an innermost enclosed space to allow for the injection of a liquid into said innermost enclosed space; and a liquid injection circuit for injecting said liquid into said innermost enclosed space to reduce the temperature of said working fluid, said liquid injection circuit including an injection passage extending from a liquid refrigerant supply member to an injection port formed in one of said scroll members, wherein said injection circuit injects said liquid into a first of said enclosed spaces at one time in said cycle of orbiting motion when said first enclosed space is out of fluid communication with said discharge diffuser, and said injection circuit injects said liquid into said innermost enclosed space at another time in said cycle when said innermost enclosed space is in fluid communication with said discharge diffuser.

13. A scroll-type compressor for handling a working fluid, comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a liquid injection circuit for injecting a liquid into an innermost enclosed space to reduce the temperature of said working fluid, said liquid injection circuit including an injection passage extending from a liquid refrigerant supply member where said liquid is at a supply pressure to an injection port formed in one of said scroll members; and a discharge diffuser having a diverging sidewall and being disposed proximate to said central position for discharging said working fluid from said innermost enclosed space, said discharge diffuser having no discharge value and being adapted to reduce the pressure of said innermost enclosed space such that said liquid injection circuit injects said liquid into said innermost enclosed space from said injection port said injection port being in communication with said discharge diffuser during said injecting of said liquid.

14. The scroll-type compressor as claimed in claim 13, wherein said injection port is disposed at a position such that said injection port injects said liquid into more than one of said enclosed spaces during each said cycles of orbiting motion.

15. The scroll-type compressor as claimed in claim 14, wherein said injection circuit injects said liquid into an intermediate enclosed space at one time in said cycle of orbiting motion when said intermediate enclosed space is out of fluid communication with said discharge diffuser, and said injection circuit injects said liquid into said innermost enclosed space at another time in said cycle when said innermost enclosed space is in fluid communication with said discharge diffuser.

16. The scroll-type compressor as claimed in claim 13, said liquid injection circuit further comprising a shut-off valve for selectively preventing fluid flow through said injection passage.

17. The scroll-type compressor as claimed in claim 13, wherein said working fluid is a refrigerant.

18. The scroll-type compressor as claimed in claim 13, wherein said scroll-type compressor is arranged in a refrigerating circuit, coupled in series with a condenser, an expansion member, and an evaporator, an outlet of said condenser forming a portion of said liquid refrigerant supply member.

19. The scroll-type compressor as claimed in claim 13, wherein said compressor is arranged in a refrigerating circuit and is adapted to compress said refrigerant in a gaseous state, said liquid injection circuit being adapted to inject said refrigerant in a liquid state.

20. The scroll-type compressor as claimed in claim 13, said liquid injection circuit requiring no pump for influencing flow of said liquid through said injection passage.

21. The scroll-type compressor as claimed in claim 13, further comprising a plenum chamber, said discharge diffuser allowing fluid communication between said plenum chamber and said innermost enclosed space during a portion of said cycle of orbiting motion, said discharge diffuser remaining open in fluid communication with said plenum chamber during normal operation.

* * * * *

UNITED STATES PATENT AND TRADEMARK OFFICE

CERTIFICATE OF CORRECTION

PATENT NO. : 5,469,716

DATED : November 28, 1995

INVENTOR(S) : Mark Bass; Alexander P. Rafalovich

It is certified that error appears in the above-indentified patent and that said Letters Patent is hereby corrected as shown below:

On the title page item [56], under Attorney, Agent, or Firm, "Harness, Dickey & Pierce" should be -- Harness, Dickey & Pierce, P.L.C. --.

Column 6, line 42, "tile" should be -- the --.

Column 6, line 50, "tile" should be -- the --.

Column 7, line 25, "value" should be -- valve --.

Column 8, line 34, "value" should be -- valve --.

Column 9, line 7, "value" should be -- valve --.

Signed and Sealed this

Twenty-eighth Day of May, 1996

*Attest:*

BRUCE LEHMAN

*Attesting Officer*

*Commissioner of Patents and Trademarks*